US006722735B2

(12) United States Patent
Lucci et al.

(10) Patent No.: US 6,722,735 B2
(45) Date of Patent: Apr. 20, 2004

(54) CHAIR WITH SYNCHRONOUSLY MOVING SEAT AND SEAT BACK

(75) Inventors: Roberto Lucci, Como (IT); Paolo Orlandini, Milan (IT)

(73) Assignee: Ditto Sales, Inc., Jasper, IN (US)

( * ) Notice: Subject to any disclaimer, the term of this patent is extended or adjusted under 35 U.S.C. 154(b) by 0 days.

(21) Appl. No.: 09/835,357

(22) Filed: Apr. 16, 2001

(65) Prior Publication Data

US 2002/0149246 A1 Oct. 17, 2002

(51) Int. Cl.[7] ..... A47C 1/024

(52) U.S. Cl. ..... 297/300.1; 297/300.2; 297/452.15; 297/320

(58) Field of Search ..... 297/354.13, 354.11, 297/377, 239, 440.16, 440.2, 440.21, 341, 342, 452.21, 452.29, 452.31, 340, 317, 316, 320, 322, 300.1

(56) References Cited

U.S. PATENT DOCUMENTS

| | | | | | |
|---|---|---|---|---|---|
| 4,046,422 | A | * | 9/1977 | Ambasz | 297/248 |
| D246,813 | S | | 1/1978 | Tolleson | |
| 4,068,888 | A | | 1/1978 | Bottemiller | |
| 4,362,336 | A | | 12/1982 | Zapf et al. | |
| 4,479,679 | A | | 10/1984 | Fries et al. | |
| 4,609,225 | A | | 9/1986 | Loucks | |
| 4,732,424 | A | * | 3/1988 | Uredat-Neuhoff | 297/292 |
| 4,744,603 | A | | 5/1988 | Knoblock | |
| 4,765,679 | A | | 8/1988 | Lanuzzi et al. | |
| 4,842,333 | A | | 6/1989 | Meiller | |
| 4,856,846 | A | | 8/1989 | Lohmeyer | |
| 4,889,385 | A | | 12/1989 | Chadwick et al. | |
| D308,143 | S | | 5/1990 | Lohmeyer | |
| 5,035,466 | A | | 7/1991 | Mathews et al. | |
| 5,076,646 | A | | 12/1991 | Matte | |
| 5,123,702 | A | * | 6/1992 | Caruso | 297/239 |
| D339,940 | S | | 10/1993 | Balderi et al. | |
| 5,267,777 | A | | 12/1993 | Valtri | |
| 5,292,177 | A | | 3/1994 | Balderi et al. | |
| 5,314,240 | A | | 5/1994 | Ishi et al. | |
| 5,338,094 | A | | 8/1994 | Perry | |
| 5,338,099 | A | | 8/1994 | Ishi et al. | |
| 5,383,712 | A | * | 1/1995 | Perry | 297/239 |
| 5,393,120 | A | | 2/1995 | Woods et al. | |
| 5,524,966 | A | | 6/1996 | Piretti | |
| 5,580,127 | A | | 12/1996 | Piretti | |

(List continued on next page.)

OTHER PUBLICATIONS

KI, "The Piretti Collection," Krueger International, Inc, (Jan. 17, 1990).
KI, "Web Site Products: Business Solutions; Dorsal Oval Leg Arm Chair with Upholstered Seat," (Oct. 10, 2000).
KI, "KI Website Sommercial Showroom: Torision on the Go," (Oct. 10, 2000).
TEKION, "Website for Tekniondharma," (Jan. 25, 2001).

*Primary Examiner*—Peter M. Cuomo
*Assistant Examiner*—Erika Garrett
(74) *Attorney, Agent, or Firm*—Maginot, Moore & Beck

(57) ABSTRACT

A chair having a synchronously moving seat bottom and seat back includes a frame having a seat bottom support portion and a seatback support portion and a seat assembly having a seat bottom and a seat back interconnected by a flexible intermediate portion. The seat bottom is slidably mounted to side support members in the bottom frame providing forward and aft movement of the seat bottom. The seat back is pivotably engaged to the seat back support portion of the frame. The flexible intermediate portion provides for cooperative movement of the seat bottom and seat back between an upright seating position and a reclined position. Preferably, the seat assembly is a one piece molded plastic shell having a flexible intermediate portion interconnecting the seat bottom and seat back. In one embodiment of the invention, the chair can be provided with legs to enable stacking of the chairs.

27 Claims, 13 Drawing Sheets

U.S. PATENT DOCUMENTS 5,582,459 A 12/1996 Hama et al.
5,683,142 A 11/1997 Gunderson et al.
D390,024 S 2/1998 DeJule
5,725,277 A 3/1998 Knoblock
5,755,488 A 5/1998 Beda et al.
5,775,774 A 7/1998 Okano
5,868,468 A * 2/1999 Wang ..... 297/239
5,899,531 A 5/1999 Koehler
5,902,012 A 5/1999 Han
5,904,397 A 5/1999 Fismen
D410,808 S 6/1999 Baumann et al.
5,924,770 A 7/1999 Tarnay et al.
D412,622 S 8/1999 DeJule
5,944,382 A 8/1999 Ambasz
RE36,335 E 10/1999 Perry
D415,912 S 11/1999 Baumann et al.
D416,407 S 11/1999 Baumann et al.
D417,570 S 12/1999 Baumann et al.
5,997,094 A * 12/1999 Cvek ..... 297/239
6,003,948 A 12/1999 Holbrook
D420,540 S 2/2000 Baumann et al.
6,056,361 A * 5/2000 Cvek ..... 297/173
6,086,153 A 7/2000 Heidmann et al.

* cited by examiner

CHAIR WITH SYNCHRONOUSLY MOVING SEAT AND SEAT BACK

FIELD OF THE INVENTION

The present invention relates generally to the field of seating and in particular to a chair in which the seat and seat back move in concert to provide a reclining position for the user.

BACKGROUND OF THE INVENTION

There is an ever-present need for economical and temporary seating space that is typically satisfied by the provision of low cost stackable chairs. The use of low to moderate cost stacking chairs is well known in the art. However, such chairs are designed not with comfort or ergonomics in mind, but rather to provide a large quantity of temporary seats for occasional use, which can ordinarily be stored and take up minimal storage space.

Recent years have brought a growing interest in the development of such chairs based on ergonomic designs intended to promote a sitting posture with a maximum of comfort. One aspect of comfort is the ability to adjust the back of the chair to suit the user. Unfortunately, most stacking chairs do not provide any adjustment capabilities and the ones that do merely provide limited flexibility in the seat back portion with little ergonomic benefit. On the other hand, home and office chairs have been produced in a variety of ergonomic designs that have mechanisms for moving the backs of the chairs into a reclining position.

Chairs featuring the ability to adjust for certain preferences of the user relating to seat height, reclining range, and the like are also well known in the art. These features are accompanied by complexity of manufacture and require the use of expensive and complicated mechanisms that are cumbersome or awkward to adjust and may be subject to malfunction. Such chairs are not suitable for stacking nor use for temporary seating.

In the prior art, U.S. Pat. No. 5,944,382 to Ambasz features a chair providing movement of both the seat and seat back. The Ambasz chair features a slideable seat and also a moveable seat back. There is a separate lumbar section between the seat bottom and the seat back making a three-part seat assembly. The seat bottom has a pair of sockets that fit over seat supporting portions of the seat frame to allow the seat bottom to slide forward and aft. The seat back slides up and down and also tilts to the rear to recline. The seat back is mounted on an articulated linkage that includes springs between the seat back and the upper portion of the linkage to bias the seat back in the upward position. Bellows members connect the seat bottom and the lumbar section and the seat back together. The Ambasz design typifies the complexity and expense of most ergonomic chair designs. Moreover, the Ambasz chair does not lend itself to stacking for storage.

One attempt to marry ergonomics with economics is shown in U.S. Pat. No. RE36,335 to Perry, which discloses a chair having a flexible frame to achieve partial reclining of the seat back. The seat back interconnects the ends of a continuous chair frame with one end projecting upward from the rear legs to the seat back and the other projecting upward from the rear of the seat to the seat back. This two-point connection to the seat back along with curved frame members through the seat back allows limited pivoting of the seat back and also limits pivoting of the seat back. The chair is stackable but of limited comfort, lacking the natural feel provided in a chair having coordinated movement between the seat and seat back.

A need has remained for a chair combining the benefits ergonomic design in a low cost and stackable chair.

SUMMARY OF THE INVENTION

Briefly describing one aspect of the invention, a chair featuring a movable seat bottom and seat back is provided. The seat bottom and seat back move in concert between an upright position and a reclined position. The chair includes a frame having a seat bottom support portion and a seat back support portion. In one embodiment, the seat bottom support portion includes a pair of side support members on which the seat bottom is slidably supported. The seat back support portion includes a transverse member to which the seat back is pivotably connected. In one aspect of the invention, this pivotable connection can be accomplished by a plurality of hooks that are preferably molded into the seat back.

The seat bottom and seat back are connected to each other in a manner that allows the seat bottom to slide forward and the seat back to recline in response to the natural forward movement of the seated user's pelvis along with pressure on the seat back from the user. With this feature, the pivotable connection of the seat back to the support frame allows the frame to act as a fulcrum. Specifically, as force is applied to an upper portion of the seat back, the back pivots about the frame, thereby exerting a force on the seat bottom, causing the bottom to slide along the seat bottom support.

In a preferred embodiment, the seat bottom and seat back are most preferably a one-piece molded plastic shell having a resilient intermediate portion interconnecting the seat bottom and seat back. The intermediate portion operates primarily as a deformable and resilient hinge. Secondarily, the resilient intermediate portion can act as a force transmitting element that translates the pivoting movement of the seat back into a fore and aft force on the seat bottom. The natural characteristics of the plastic shell causes it to rebound to the original position without the use of any mechanical devices as the user brings herself back to the non-reclined position or rises out of the chair.

In certain features, the resilient intermediate portion forms a slack region that exhibits a first curvature when the seat is in an original, non-reclined orientation. When the user reclines, the seat back pivots, the seat bottom slides, and the intermediate slack region deforms to a different second curvature. The resilient intermediate region is configured to allow the user to easily recline the seat by leaning back against the pivotable seat back, while the seat back maintains support for the user's back at any angle of recline.

The invention further contemplates the use of rail members and slide blocks to effect sliding of the seat bottom. In one preferred aspect, the upper portions of multiple slide blocks are integral with the underside of the seat bottom. Lower portions of the slide blocks can be combined to form a channel slidably surrounding a corresponding one of the rail members. Stops can be provided at opposite ends of the rail members to limit the fore and aft movement of the seat bottom relative to the seat frame.

In one embodiment of the invention, the chair is provided with legs configured to facilitate stacking, while still retaining the pivoting seat back and sliding seat bottom features. In an alternative embodiment, the chair can be provided with a castered pedestal base for ease of movement. Similarly, the chair can be provided with or without arms. In certain armchair versions, the arms project from the back frame at a slight outward angle and with a slight curvature to provide a comfortable seating experience for the user.

Accordingly, it is one object of the invention to provide an ergonomic chair of relatively simple construction, without mechanical springs or lever devices, and at a reasonable cost. Another object is achieved by features of the invention that allow a user to easily recline the chair while the seat back maintains support for the user's back.

Another object of the invention is to provide a chair with a one-piece molded shell that can be not only reclined, but also easily stacked when not in use. These and other objects, advantages and features are accomplished according to the devices and assemblies, and methods of the present invention.

DESCRIPTION OF THE PREFERRED EMBODIMENTS

Figure 1:
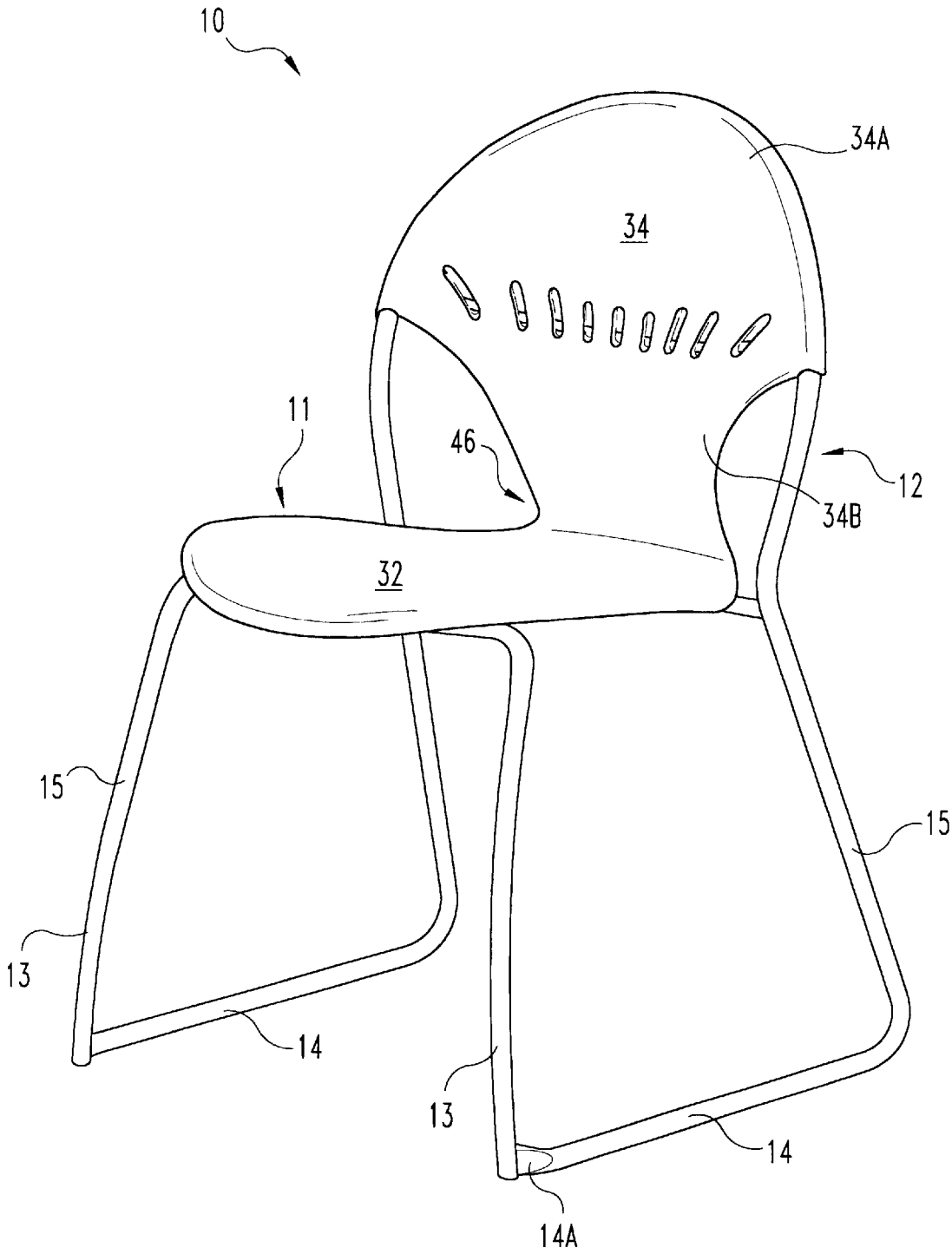
FIG. 1 is a front perspective view of a chair according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention that would normally occur to one skilled in the art to which the invention relates.

The present invention provides a chair with a synchronously moving seat and seat back. The seat slides forward as the seat back tilts rearward to provide a reclined seating position in response to the natural forward movement of the seated user's pelvis along with the user leaning against the seat back. The resilience of the seat allows it to return to an upright seating position when the pressure on the seat back is removed.

Referring to the drawings, a chair 10 in accordance with one embodiment of the invention is illustrated in FIG. 1. The chair 10 includes a seat assembly 11 and a frame 12. Frame 12, which is preferably of a metal construction such as steel, is shown in detail in FIGS. 2–3. Frame 12 includes a seat bottom support member or portion 20, and a seat back support member or portion 16. Seat bottom support 20 includes front and rear transverse members 22A and 22B respectively, and a pair of frame rails or side support members 24. Preferably, side support members 24 are the primary elements supporting the seat bottom 32 when the seat assembly 11 is mounted on the frame 12. Preferably, the elements of the frame 12 are of tubular construction, most particularly the frame rails or side support members 24.

Seat back support portion 16 includes a pair of upright support members 17, and a transverse support element 18 that interconnects the upper ends 19A, 19B of the upright support members 17. Transverse support element 18 is preferably positioned at approximately the center of the seat back when the seat assembly 11 is in place on the frame 12. As shown more clearly in FIG. 3, transverse support element 18 has a center portion 18A that is displaced rearwardly from the upright support elements 17 in this embodiment. Right and left end sections, 18B and 18C extend at an angle $\alpha$ forward and also slightly upward from center section 18A to connect to the upright support elements 17 and to maintain contact with shell hook members described herein. End sections 18B and 18C also angle forward to accommodate a curvature or concavity of the seat back 34.

Figure 2:
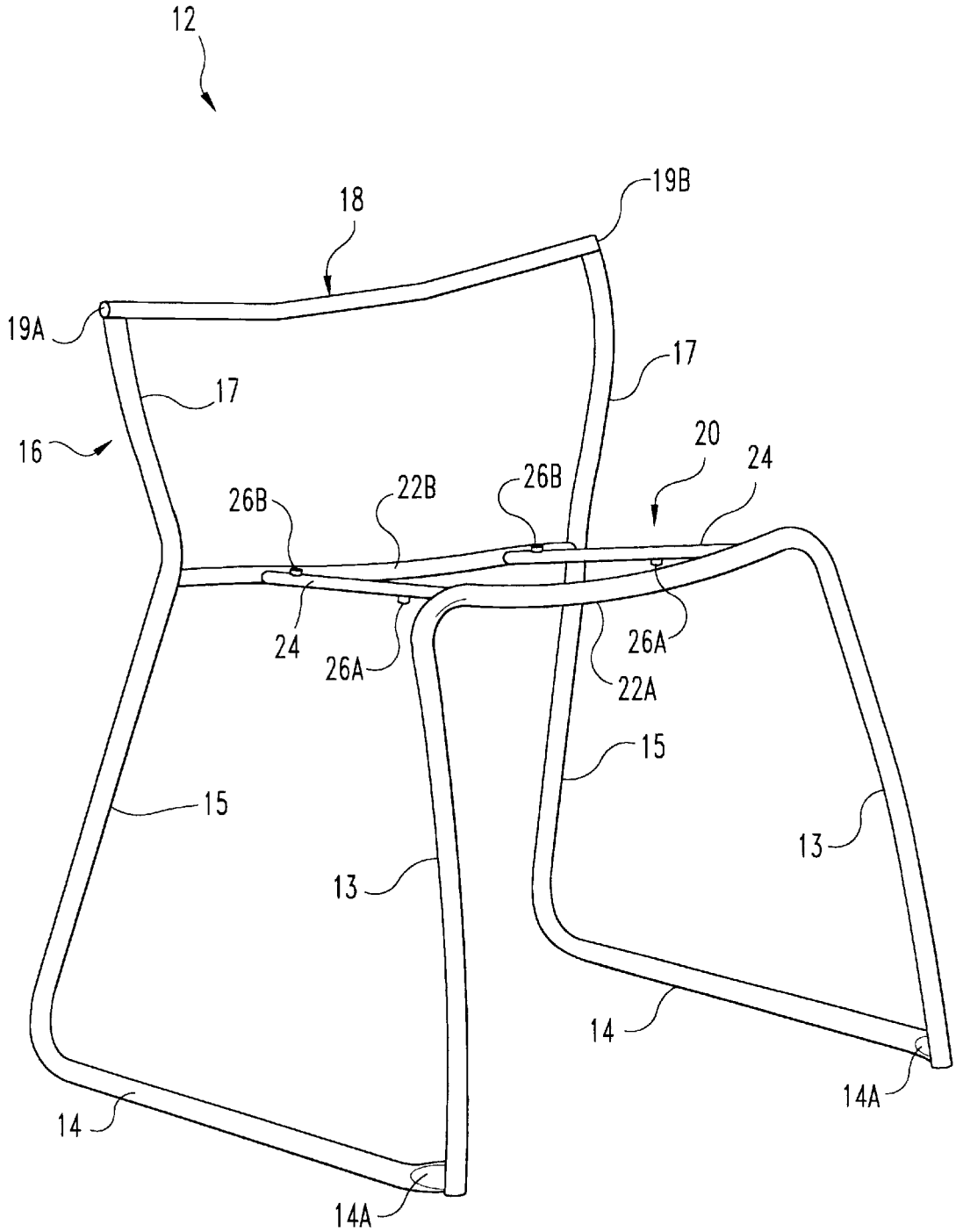
FIG. 2 is a side perspective view of a chair frame for use with the embodiment of the inventive chair depicted in FIG. 1.
Figure 3:
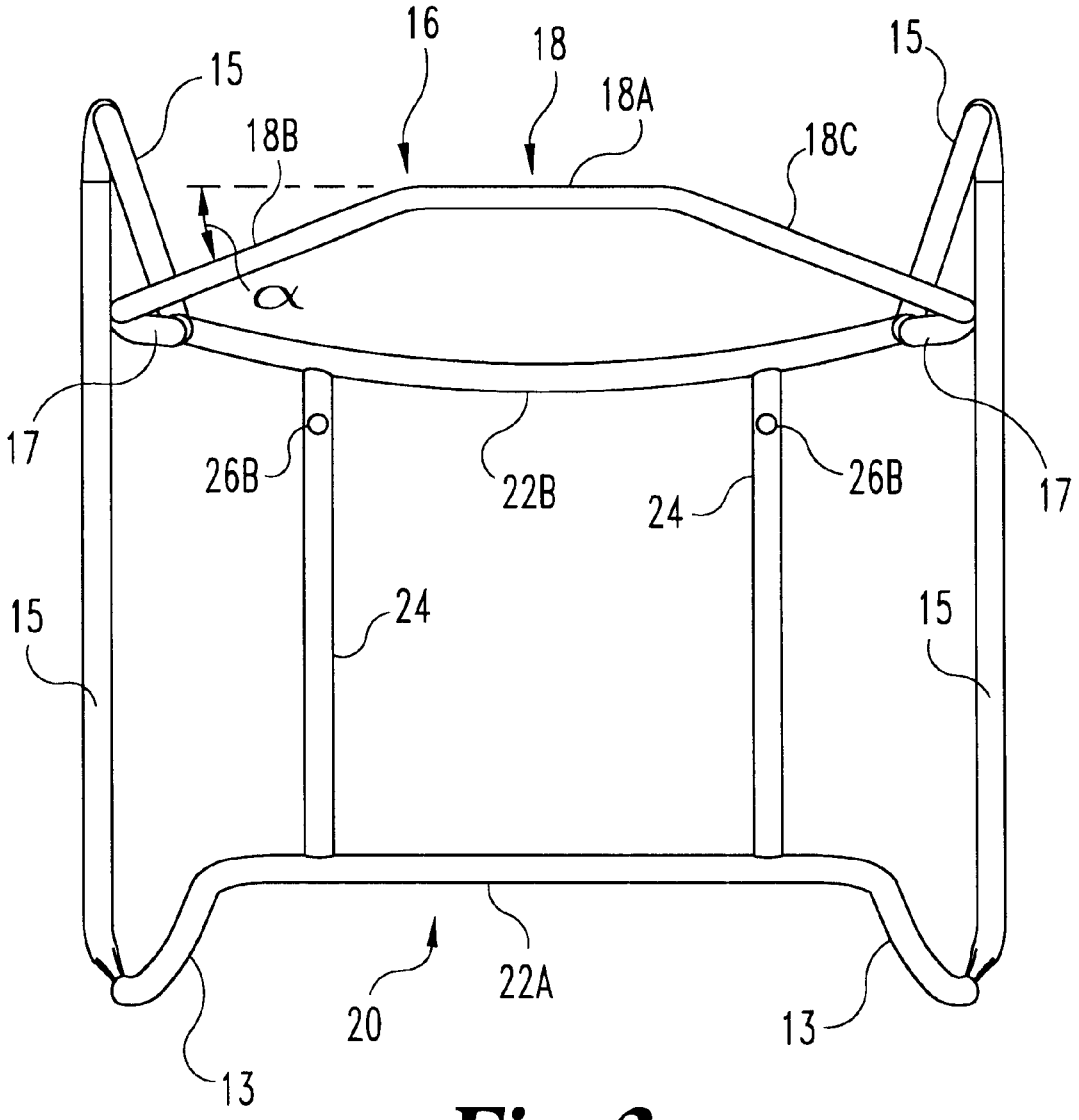
FIG. 3 is a top elevational view of the chair frame shown in FIG. 2.

In one embodiment of the invention, as depicted in FIGS. 2 and 3, the chair is supported by front legs 13 and rear legs 15. Preferably, front legs 13 project slightly forward and outwardly from seat bottom support portion 20, while rear legs 15 project slightly outward and rearwardly from seat back support portion 16. In this particular embodiment, each rear leg 15 is connected to the corresponding front leg 13 with a ground-engaging component or floor member 14 in a sled configuration. In this embodiment, each floor member 14 is integral with the corresponding rear member 15 and is welded at a weld point 14A to the corresponding front leg 13.

Figure 4:
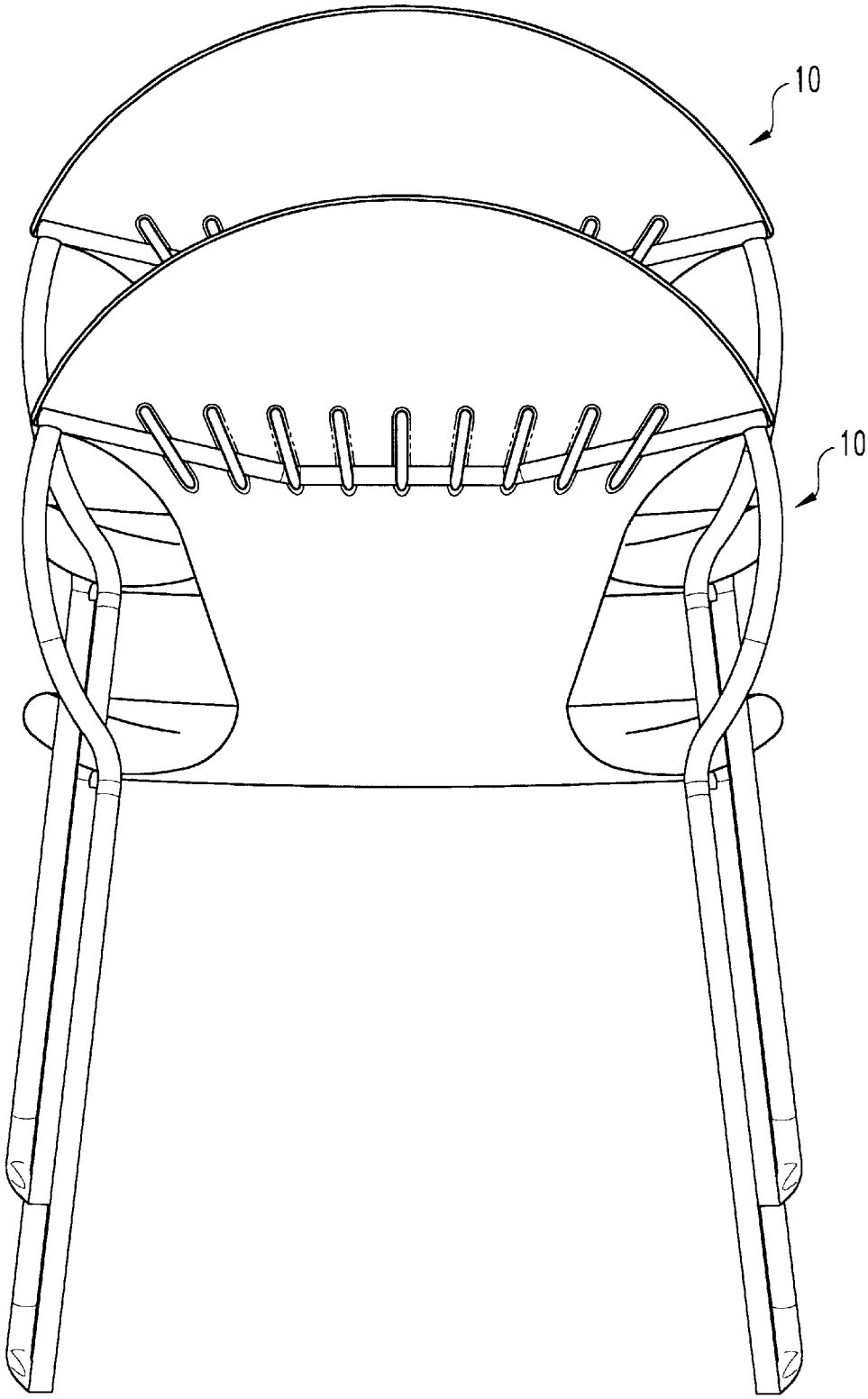
FIG. 4 is a back elevational view of two chairs according to the present invention depicted in a stacked arrangement for storage.

These features provide stability to the chair while in use and also allow the chair to be stacked when not in use. In one embodiment, the configuration of the legs 13 and 15 allows the chair 10 to be stacked with other similar chairs to facilitate storage, as depicted in FIG. 4. In this embodiment, the seat assembly 11, and particularly the seat bottom 32 has a width, and the legs 13 and 15 are flared outwardly to a width greater than the width of the seat bottom to allow the chairs to be stacked.

For certain features of the invention, the configurations of the legs 12, 13 and floor member 14 are not critical and any suitable design is contemplated. Other suitable configurations include, but are not limited to, four-leg, cantilever and caster-based styles.

Returning now to FIG. 1, seat assembly 11 includes a seat bottom 32 and a seat back 34. In accordance with beneficial features of the invention, seat bottom 32 is slidably engaged to frame rails 24, while seat back 34 is pivotably supported by the transverse support element 18. Most preferably, the seat back 34 is supported at the center section 18A of transverse support element 18 with a plurality of connectors. The seat back 34 is positioned relative to the transverse support element 18 so that an upper portion 34A of the seat back is situated above the support element. In this way, the user can apply pressure or force against the upper portion 34A to recline the chair 10, with the support element 18 acting as a fulcrum.

Figure 5:
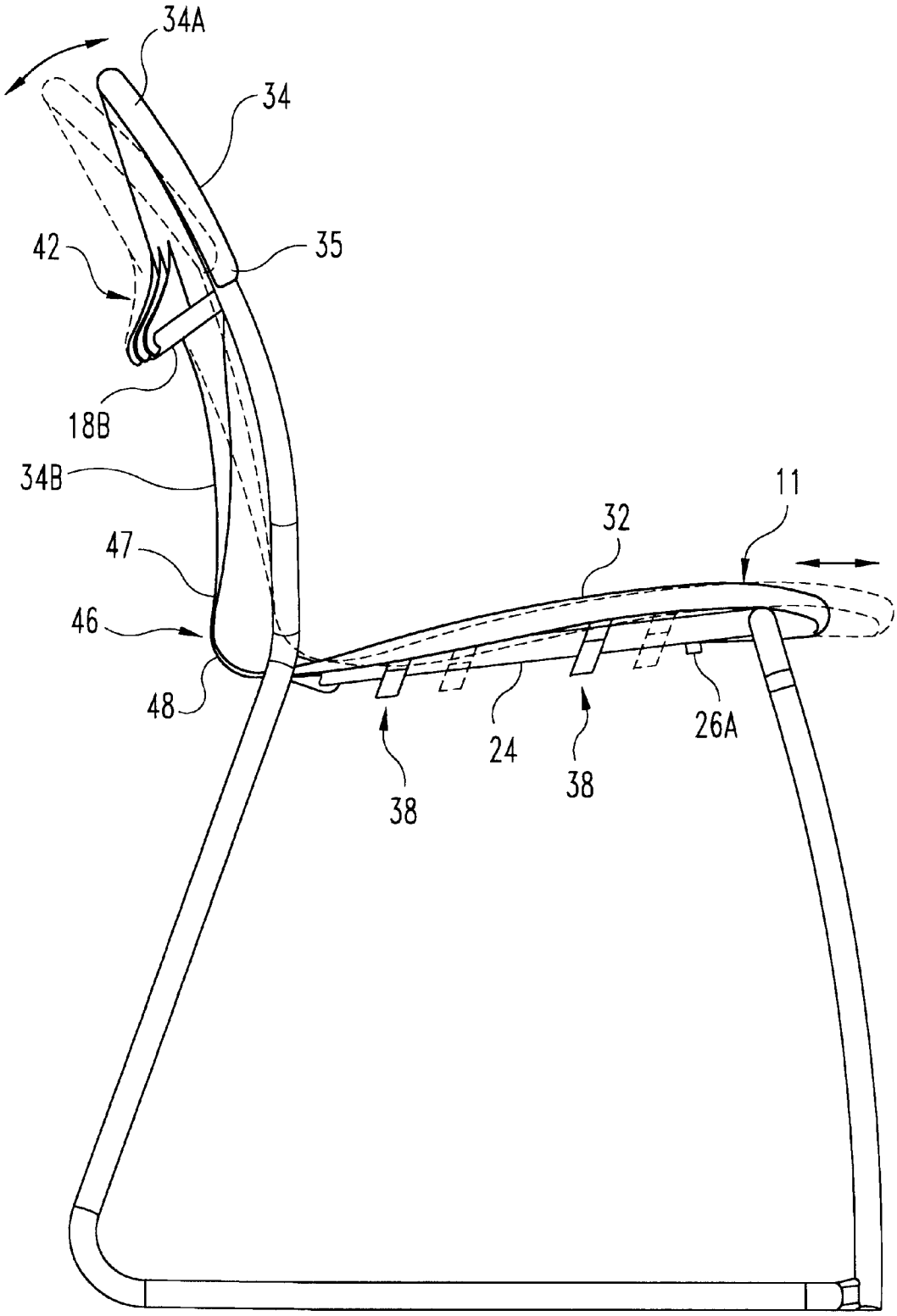
FIG. 5 is a side elevational view of the chair shown in FIG. 1.
Figure 6:
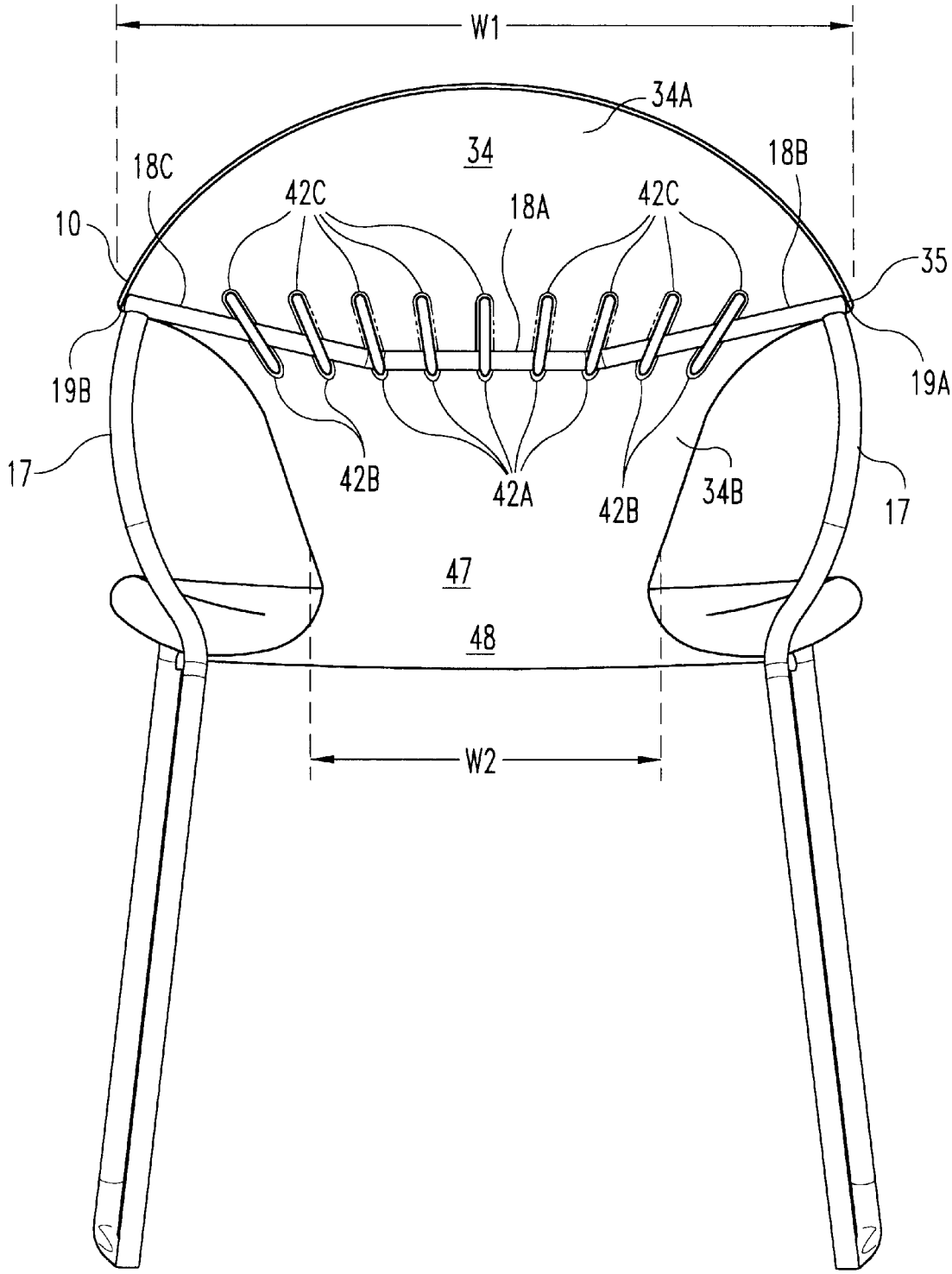
FIG. 6 is a rear elevational view of the chair shown in FIG. 1.

FIG. 3 shows a preferred angular configuration of transverse support member 18. This geometry accommodates a concave curvature in the seat back 34, which provides comfort for the user throughout the entire range of movement of the chair. In particular, the center section 18A is supported by left and right sections 18B and 18C. FIGS. 3, 5 and 6 show the upward projection of the right and left sections 18B and 18C of transverse support element 18.

In a preferred embodiment, the seat back 34 is pivotably supported on the support element 18 by way of a number of connectors 42 that engage the support element. In a preferred embodiment, these connectors are hooks 42A and 42B attached to the seat back 34 as shown in FIGS. 5 and 6. Most preferably, hooks 42A and 42B also are formed with stiffening ribs 42C to add stiffness to seat back 34. Stiffening ribs 42C also blend hooks 42A and 42B into seat back 34 for a more aesthetic effect to the rear side of seat back 34.

Center section 18A of transverse support element 18 is a pivot axis or fulcrum about which seat back 34 can pivot or rotate to and from a reclined seating position. The hooks or connectors 42 attaching seat back 34 to the transverse support element 18 are preferably of two types. Referring to FIG. 6, hooks 42A engage the center section 18A with a snap-fit to limit the motion of seat back 34 to that of rotation relative to this section of transverse support element 18. The snap-fit hooks 42A thus help retain the seat back 32, and ultimately the entire seat assembly 11, engaged to the chair frame 12. The second type of hooks, hooks 42B supported on the angled portions 18B and 18C of the transverse support element 18 preferably do not clamp or snap-fit to the transverse support element 18. Most preferably, hooks 42B are provided with clearance to move relative to transverse support element 18 as seat back 34 rotates.

Figure 7:
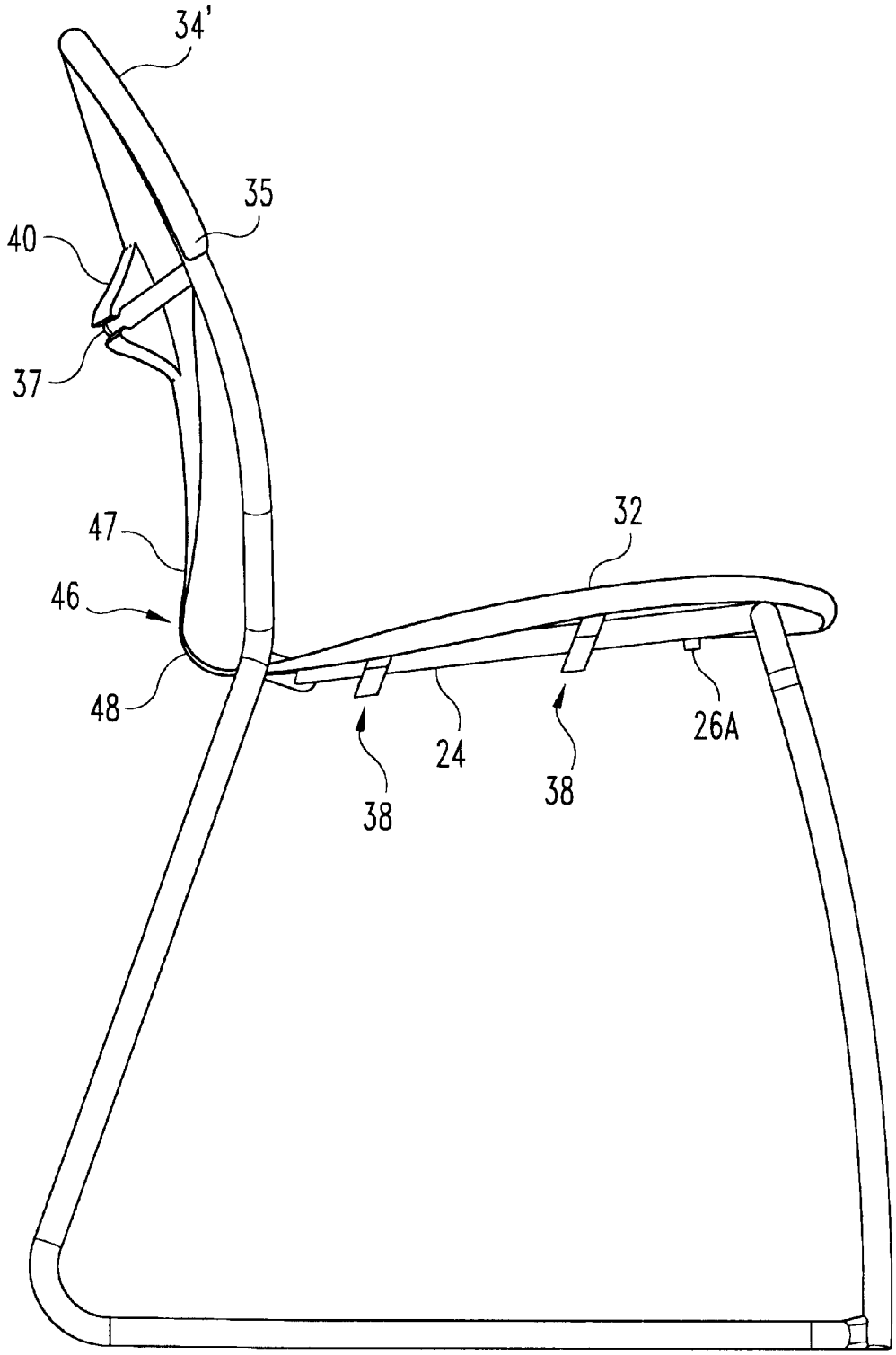
FIG. 7 is a side elevational view of a chair according to an alternative embodiment of the present invention.
Figure 8:
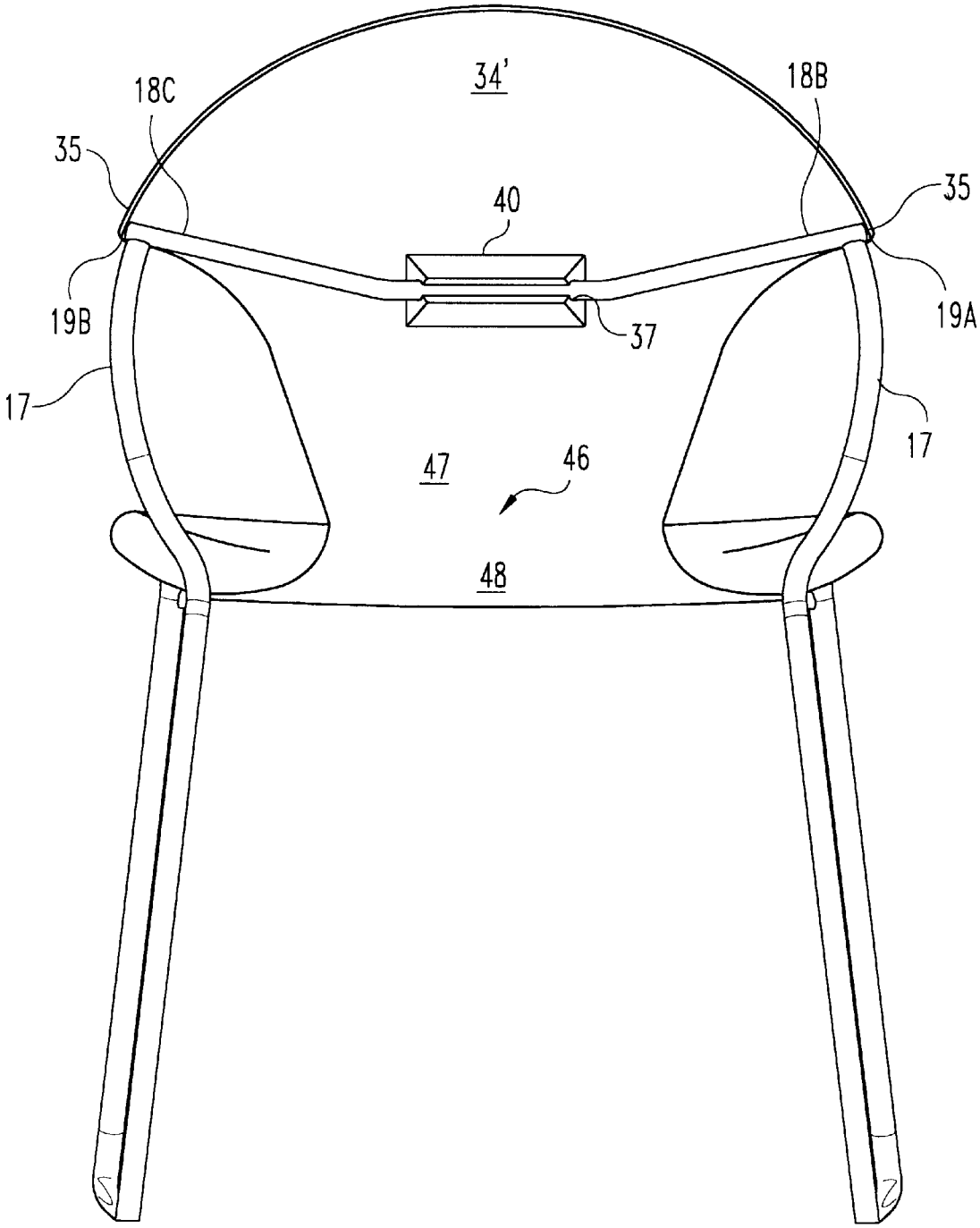
FIG. 8 is a rear elevational view of the chair shown in FIG. 6.

In accordance with certain features of the present invention, any suitable connector 42 is contemplated so long as the transverse element 18 is freely rotatable to ensure smooth movement of the chair. For instance, in an alternative embodiment, hooks 42A could be replaced by mounting pad 40 mounted on seat back 34', as depicted in FIGS. 7 and 8. The mounting pad 40 defines a recess 37 configured for snap-fits onto center section 18A. Mounting pad 40 is preferably integral with seat back 34' and can be used either alone or in combination with hooks 42B on sections 18B and 18C of transverse support element 18.

Referring again to FIGS. 5 and 6, seat back 34 can include a lip 35 that wraps around the upper ends 19A, 19B of upright support members 17 to prevent any lateral movement of the seat back relative to the frame. In addition, the peripheral lip 35 adds stiffness to the seat back 34, particularly when the seat assembly 11 is in the form of a molded shell.

Seat assembly 14 preferably includes a resilient intermediate portion 46 which provides hinge movement, as shown most clearly in FIGS. 1, 5 and 7. Intermediate portion 46 interconnects seat bottom 32 and seat back 34 and links relative movement between seat bottom 32 and seat back 34. In a preferred embodiment, intermediate portion 46 includes an upper region 47 connected to the bottom portion 34B of seat back 34, and a slack region 48 connected to seat bottom 32. Upper region 47 preferably exhibits a curvature that provides lumbar support to the user in both reclined and upright seating positions. Slack region 48, also referred to as a rebound section, exhibits a slight rearwardly curved projection that provides slack in the seat material. This slack is taken up as the seat bottom 32 slides forward on the rails 24, without being lifted from the seat frame 20. Referring specifically to FIG. 5, the intermediate portion 46 is resiliently deformable and exhibits a first curvature in an original position of the slack region 48. As the seat is reclined, the intermediate portion deforms to a different second curvature, as the slack portion is slightly flattened out.

As shown most clearly in FIG. 6, intermediate portion 46 preferably has a nominal width $W_2$ that is less than the width $W_1$ of seat back 34. This reduced width is most advantageous when the seat back 34 has a concave curvature to provide adequate clearance for a person sitting in the chair. Of course, the relationship between the two widths is not critical, and $W_2$ may equal or exceed $W_1$.

Preferably, seat assembly 14 will be composed of a resilient material at intermediate portion 46. Most preferably, seat assembly 14 is a one-piece shell made from a resilient material, such as polypropylene or other similar materials. However, it is important that the intermediate portion be able to withstand repeated flexing or deformation as the seat is reclined and then returned to its upright position. Most preferably, the intermediate portion 46 is not only resilient, but also sufficiently stiff to transmit force, generated by the pivoting movement of the seat back 34 to the seat bottom 32. This transmitted force can assist the sliding movement of the seat bottom along the frame 12 and assist the return of the seat bottom to its original non-reclined position.

Figure 9:
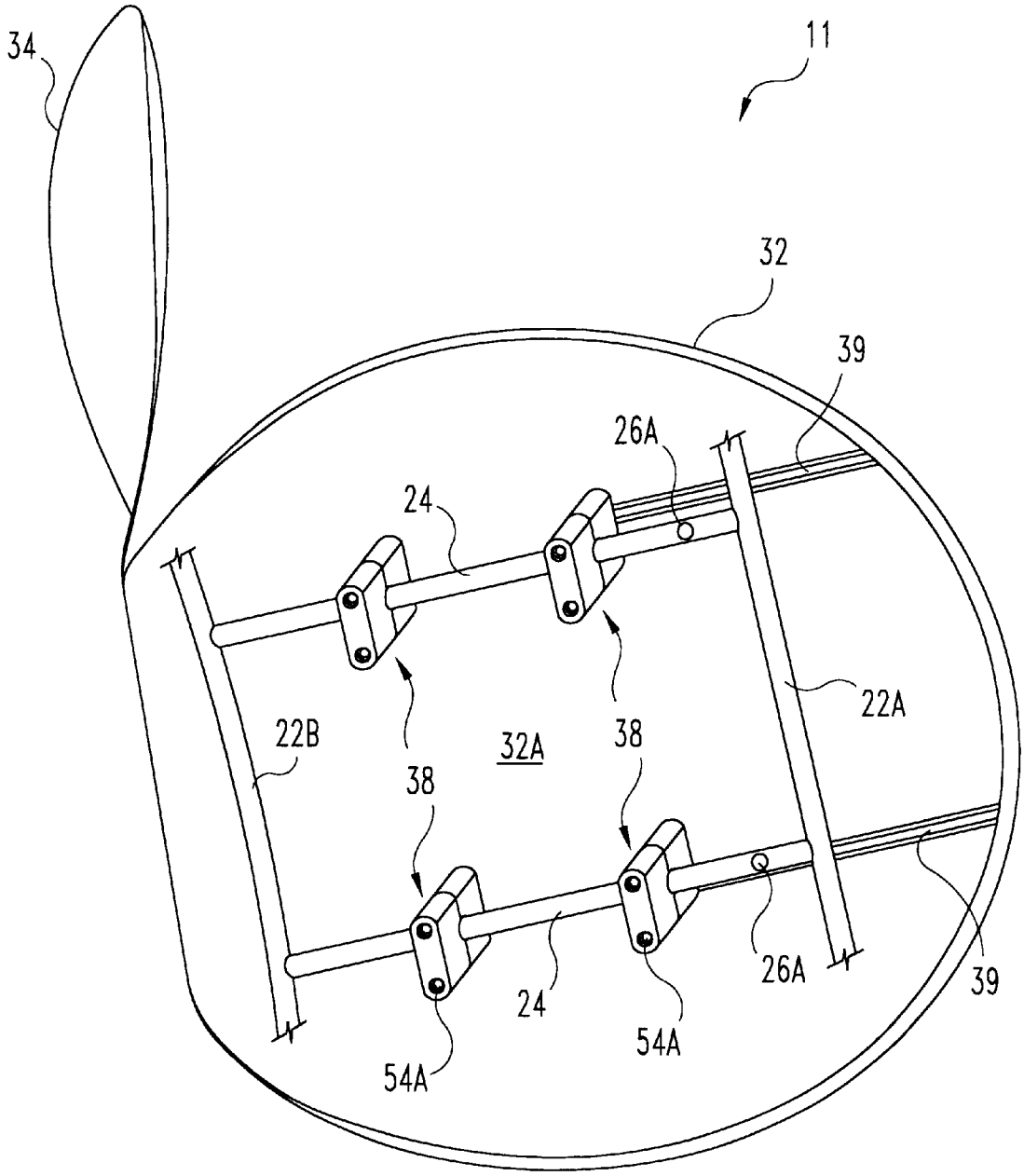
FIG. 9 is a bottom perspective view of a chair, such as the chair depicted in FIG. 1, showing the attachment of the seat bottom to the bottom frame according to one aspect of the invention.
Figure 10:
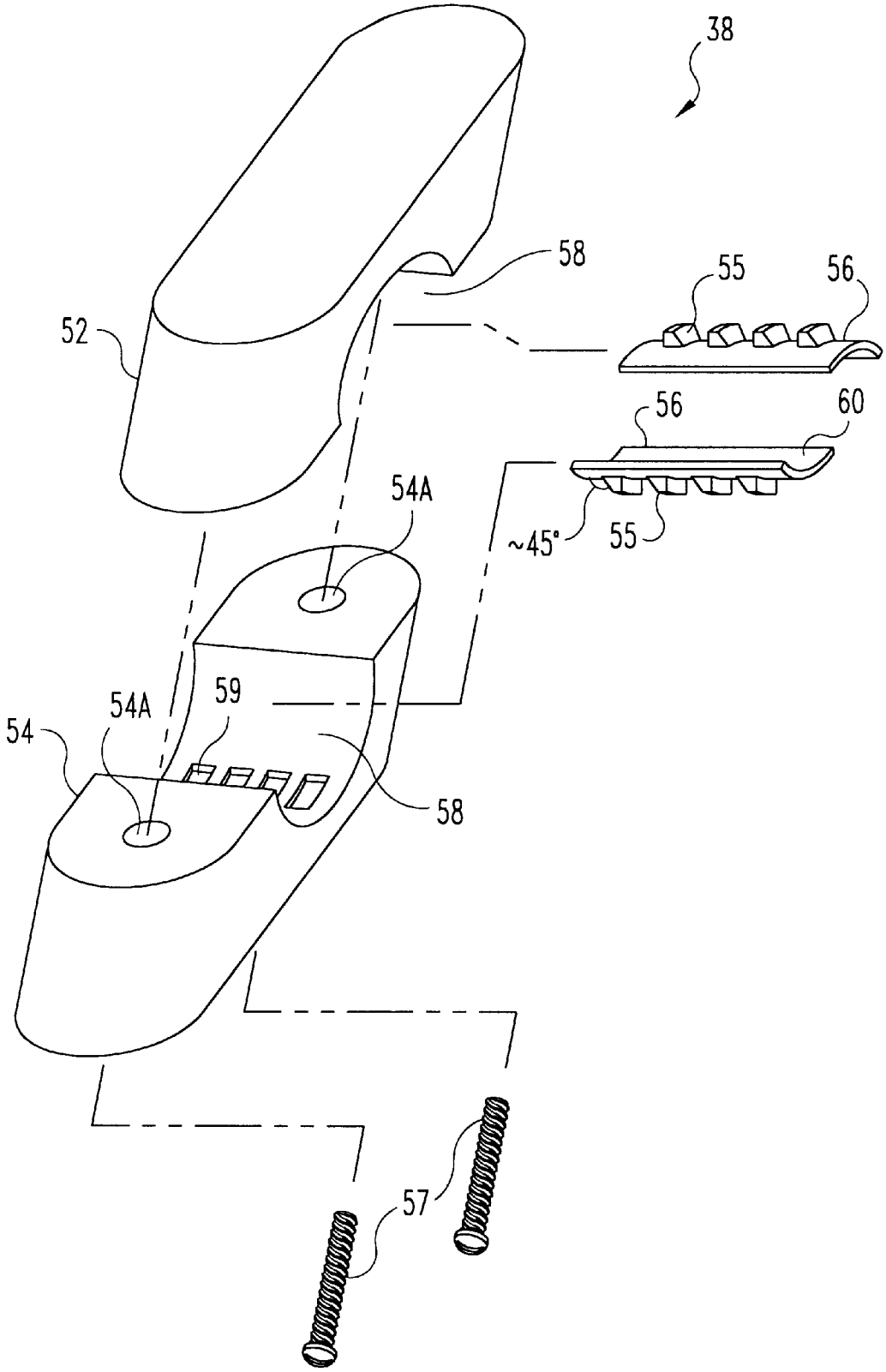
FIG. 10 is an exploded view of a slide block assembly according to one embodiment of the invention for use in the attachment depicted in FIG. 8.

Seat assembly 11 preferably includes at least one slide block 38 connecting seat bottom 32 to frame rails 24, as shown in FIGS. 5, 9 and 10. One version of slide block 38 is shown in detail in FIG. 10. Slide block 38 has an upper portion 52 connected to a lower surface 32A of seat bottom 32 (FIG. 9) and a lower portion 54. Suitable fasteners such as screws 57 connect these two portions 52, 54 via threaded holes. In this particular embodiment, lower portion 54 can define a pair of through-holes 54A for inserting screws 57 to engage corresponding holes (not shown) in upper portion 52. The corresponding holes can be, for example, threaded or self-threading.

Each portion 52, 54 of the slide block 38 defines a channel 58 or upper and lower portions of a bore configured to receive a frame rail member 24. In a preferred embodiment, each half of the slide block 52, 54 also includes a self-lubricating bushing 56 inserted into channels 58. The shape of bushings 56 correspond to that of channels 58. Bushings 56 provide bearing surfaces 60 to reduce friction as the seat bottom 32 slides along the side support members 24. In one particular embodiment, tabs 55 projecting from bushings 56 are receivable in corresponding slots 59 in the slide block upper and lower portions 52, 54 to lock the bushings 56 in position. Tabs 55 are preferably positioned to form an angle of less than about 90°, with a most preferred angle of about 45°. Bushings 56 are preferably made of a material such as polyamide resin, which is preferably harder than the material of the chair seat assembly 11 or the slide block 38 bodies.

In a preferred embodiment, the upper portion 52 of the slide block 38 can be made integral with the lower surface 32A of seat bottom 32. In this embodiment, the side support members or rail members 24 are parallel to each other and extend forward and aft in the direction of motion of seat bottom 32. Also, in a preferred embodiment of the invention, two such slide blocks are used on each side support member.

It is contemplated that a suitable number of slide blocks will be used as required for the smooth operation and stability of the chair.

Referring now to FIGS. 2 and 9, each side support member or rail 24 preferably includes a pair of stops 26A, 26B for limiting the travel of the seat assembly 11. Front stops 26A limit forward travel, while rear stops 26B limit rearward movement and help define the original non-reclined position of the seat bottom 32. In this particular embodiment, front stops 26A are provided on a bottom surface of the frame rails 24, away from the underside of the seat bottom. On the other hand, back stops 26B project from the top surface of the rails 24, adjacent or facing the underside of the seat bottom. It has been determined through testing that the chairs of this invention, with the stops configured in this manner, can have a greater resistance to damage from impact when the chair is dropped. However, stops can be provided on any suitable surface of the frame rails 24. Alternatively, front and rear transverse members 22A and 22B can perform this limiting function.

Referring again to FIG. 9, seat bottom 32 also preferably includes reinforcement or stiffening ribs 39. Ribs 39 can be molded into seat bottom 32 to add strength to the front portion of seat bottom 32, particularly when the seat is reclined. In the preferred embodiment, the seat bottom is configured so that a portion is cantilevered over the support frame 12. The ribs 32 project into this cantilevered portion, adding stiffness and allowing the amount of front overhang of seat bottom 32 relative to front transverse member 22A to be increased. Moreover, the ribs 32 extend inboard of the seat bottom for sliding support on the frame 12, and most particularly the front transverse member 22A.

Numerous variations of the invention are contemplated. For instance, the frame rail or side support members 24 can be non-parallel, in which case a channel would be provided in the seat bottom to allow for lateral movement of the slide blocks in response to the divergence of the side support members. Alternatively, the slide block could be modified to include a slot wide enough to accommodate the divergence of the side support members.

In another version of the invention, the side support members could comprise a slotted structure configured to receive a pin attached to the underside of the seat bottom. The slots in the side support members can then act as a channel within which the pin travels as the seat slides back and forth. The length of the channels could determine the extent of motion provided to the seat bottom. Here again, if the side members are not parallel to each other, the seat bottom could include a transverse slot for each pin to allow lateral movement of the pin relative to the seat bottom to accommodate the lateral motion introduced by the non-parallel side support members.

Referring again to FIG. 5, in use, the seat back 34 reclines as the seat bottom 32 extends in response to a user leaning back against seat back 34 and the natural forward movement of the user's pelvis. The extension of seat bottom 32 and the rotation of seat back 34 causes deformation of the intermediate portion 46 from its original configuration, thereby placing this portion in tension. This tension in intermediate portion 46 causes the seat to return to its upright position when unoccupied or when the user of the chair removes pressure from the seat back 34. The resilience of the seat 11 causes it to rebound to the original position without the use of any mechanical devices.

Figure 11:
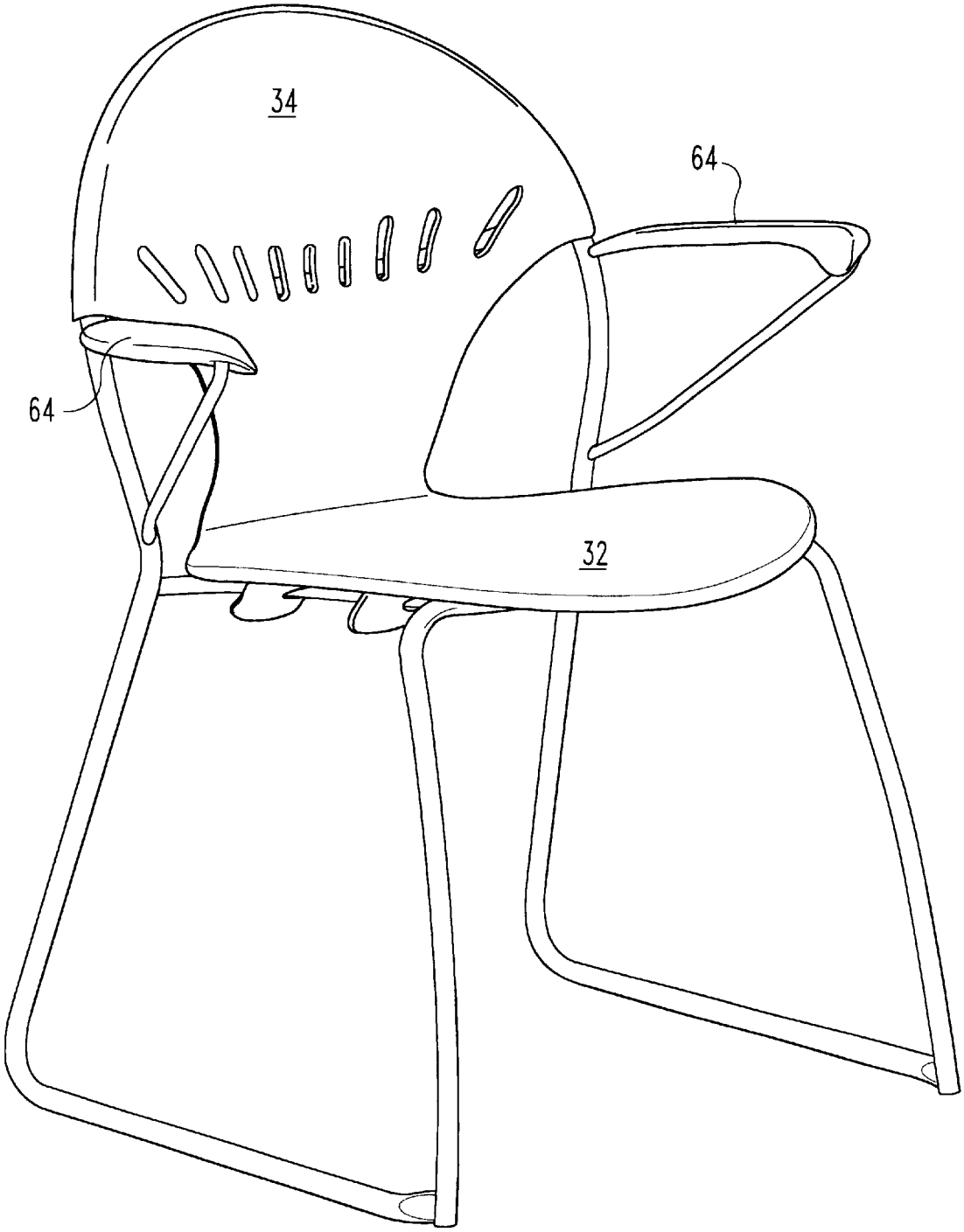
FIG. 11 is a front perspective view of an armchair according to one embodiment of the present invention.
Figure 12:
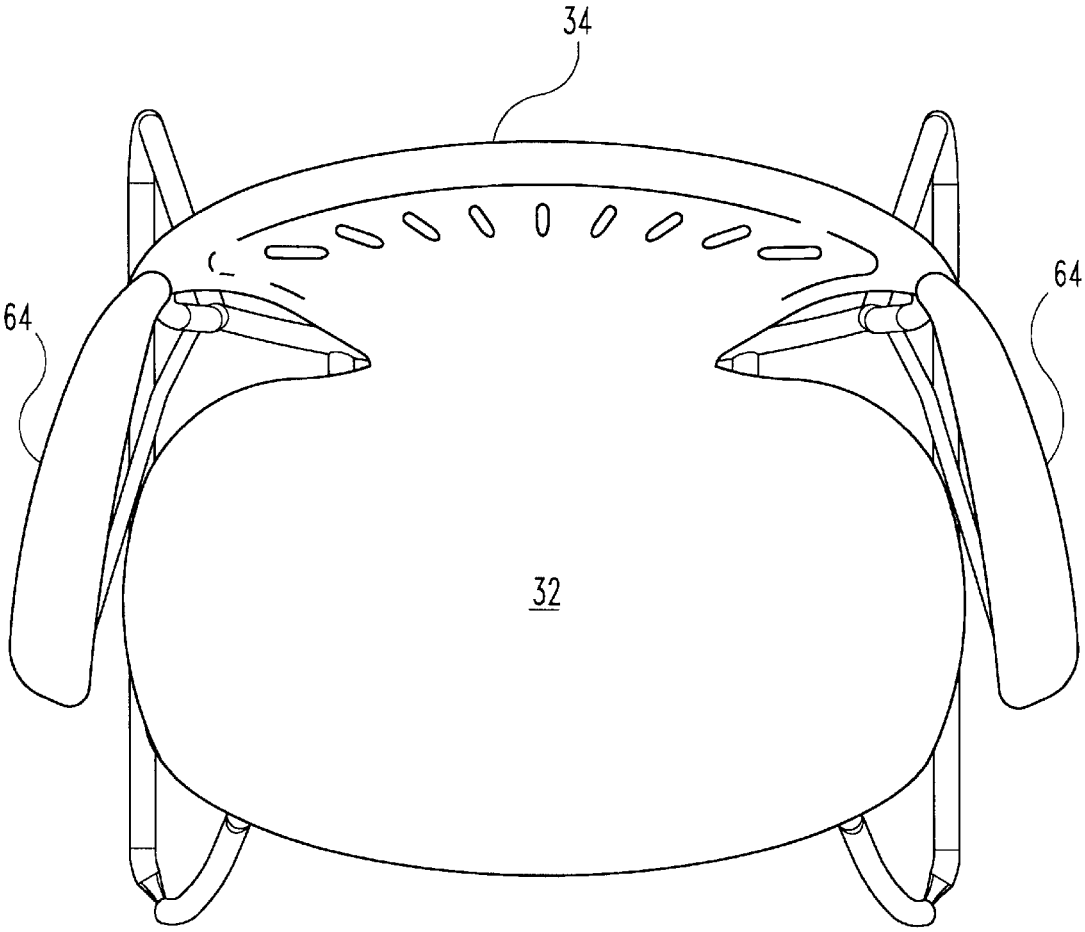
FIG. 12 is a top perspective view of the chair shown in FIG. 11.
Figure 13:
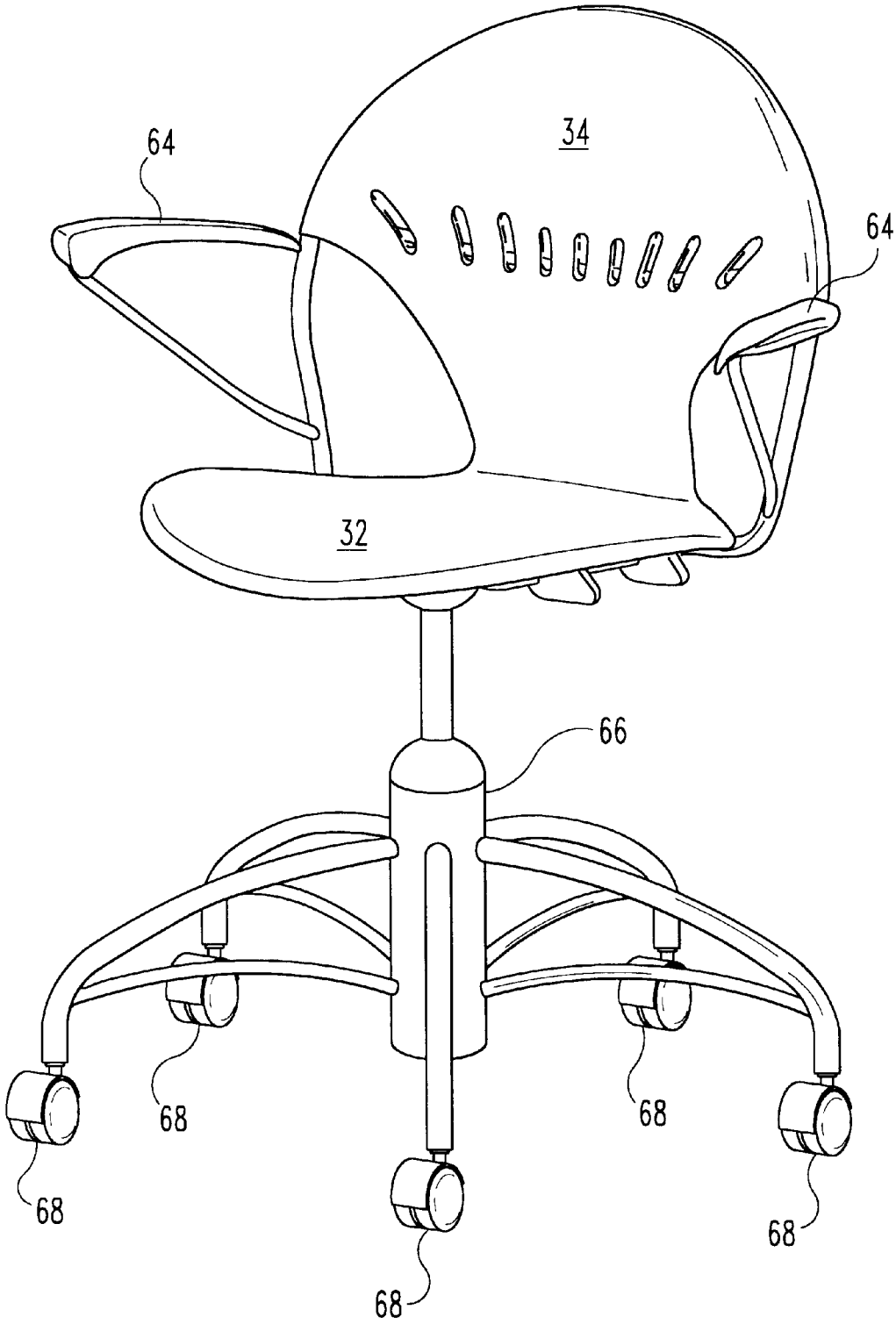
FIG. 13 is a front perspective view of a chair including armrests and a castered pedestal base according to another embodiment of the present invention.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected. For example, arms 64 can be provided to produce an armchair as in FIGS. 11 and 12. As shown in FIG. 12, arms 64 preferably flare slightly outward and exhibit a slight inward curvature to provide a more natural and more comfortable seating position. In addition, these features more comfortably accommodate the larger user and allow for the free movement from side to side. In yet another version of the invention, the seat bottom frame can be mounted on a pedestal base 66 as in FIG. 13, which includes castors 68 for ease in moving the chair.

This invention presents an aesthetically pleasing ergonomic chair of simplified design. The simplified design allows the chair to be produced at a reasonable cost. The stackable feature allows the chair to be stored within a minimum of space when not in use. It should be noted however, that the user does not have to change his position relative to the seat bottom of the chair in order to move the chair from an upright to a recline position. The user need only relax and lean back against the seat back. Thus the seating position can be changed without undue ruffling and disturbance of clothing. This provides a further benefit in embodiments in which the chair is upholstered because the movement of the user in the chair does not cause wear on the upholstery. One of the most important features of this invention is that the chair remains comfortable to the user even after long periods of time due to its ability to respond when the user changes seating position. The user merely sits back, and the chair knows what to do.

What is claimed is:

1. A chair comprising:

a seat member having a seat back, a seat bottom and a resiliently deformable intermediate portion connected between said seat back and seat bottom;

a bottom support member having a bearing surface slidably supporting said seat bottom thereon, said bottom support member including;

at least one ground-engaging leg; and at least one rail member connected to and supported by said leg, said at least one rail member defining said bearing surface;

a seat back support member connected to said bottom support member and disposed adjacent said seat back; and a pivot element connected to said seat back support member and pivotably supporting said seat back, whereby said intermediate portion deforms as said seat back pivots about said pivot element and said seat bottom slides along said bearing surface.

2. The chair according to claim 1, wherein said seat member is a one-piece shell.

3. The chair according to claim 1, wherein:

said seat back support member includes a support bar spanning at least a portion of said seat back; and said pivot element includes at least one connector projecting from said seat back and configured to pivotably engage said support bar.

4. The chair according to claim 3, wherein said at least one connector includes a hook configured to pivotably engage said support member.

5. The chair according to claim 3, wherein said at least one connector includes a plurality of hooks configured to pivotably engage said support bar.

6. The chair according to claim 5, wherein at least one of said plurality of hooks is configured for snap-fit engagement of said support bar.

7. The chair according to claim 5, wherein at least one of said plurality of hooks defines a stiffening rib extending along a portion of said seat back.

8. The chair according to claim 3, wherein said at least one connector is integral with said seat back.

9. The chair according to claim 3, wherein:

said seat back defines a concavity at least adjacent said support bar; and said support bar includes substantially linear center section and opposite end sections connected at an angle to said center section so that said support bar accommodates said concavity of said seat back.

10. The chair according to claim 9, wherein said at least one connector includes a first plurality of hooks configured to pivotably engage said center section of said support bar.

11. The chair according to claim 10, wherein said at least one connector includes a second plurality of hooks configured to pivotably engage said opposite end sections of said support bar.

12. The chair according to claim 11, wherein only said first plurality of hooks is configured for snap-fit engagement with said support bar.

13. The chair according to claim 1, wherein said intermediate portion includes a slack region that is recessed relative to a plane including said seat back.

14. The chair according to claim 1, wherein said intermediate portion has a reduced width less than a largest width of said seat back.

15. The chair according to claim 1, wherein said bottom support member includes a pair of opposite ground-engaging leg members.

16. A chair comprising:

a one-piece shell including a seat back having an upper end and a lower end, and a seat bottom extending from said lower end of said seat back; a bottom support member having a bearing surface slidably supporting said seat bottom thereon, said bottom support member including;

at least one ground-engaging leg; and at least one rail member connected to and supported by said leg, said at least one rail member defining said bearing surface;

a seat back support member connected to said bottom support member and disposed adjacent said seat back; and a pivot element connected to said seat back support member and pivotably supporting said seat back between said upper end and said lower end.

17. The chair according to claim 16, wherein:

said seat back support member includes a support bar spanning at least a portion of said seat back; and said pivot element includes at least one connector integrally formed with and projecting from said seat back and configured to pivotably engage said support bar.

18. The chair according to claim 16, wherein said at least one connector includes a plurality of hooks configured to pivotably engage said support bar.

19. The chair according to claim 17, wherein at least one of said plurality of hooks is configured for snap-fit engagement of said support bar.

20. The chair according to claim 17, wherein at least one of said plurality of hooks defines a stiffening rib extending along a portion of said seat back.

21. The chair according to claim 16, wherein said seat bottom includes a portion cantilevered beyond said bottom support member.

22. The chair according to claim 21, wherein said bottom support member includes:

a pair of opposite ground-engaging leg members at least one rail member connected to and supported by said pair of leg members, said at least one rail member defining said bearing surface; and a transverse member connected between said pair of leg members and providing cantilever support for said portion of said seat bottom.

23. The chair according to claim 22, wherein said seat bottom includes at least one rib defining a sliding surface for sliding contact with said transverse member.

24. The chair according to claim 23, wherein said at least one rib spans said cantilevered portion of said seat bottom and is configured to provided stiffness against bending.

25. A chair comprising:

a seat back having an upper portion and a lower portion;

a seat bottom;

a frame connected to and supporting said seat back and said seat bottom, said frame including;

a substantially horizontal bottom support member slidably supporting said seat bottom; and a pivot member pivotably supporting said seat back between said upper portion and said lower portion to permit pivoting of said seat back relative to said frame upon application of a force at said upper portion; and a force transmitting element connected between said lower portion of said seat back and said seat bottom and responsive to pivoting of said seat back relative to said frame to apply a force to said seat bottom to slide seat bottom on said rail member.

26. The chair according to claim 25, wherein said force transmitting element is a resiliently deformable slack portion integrally formed between said seat back and said seat bottom and operable to restore said seat back and said seat bottom to an original position when the force applied to said upper portion of said seat back has been removed.

27. The chair according to claim 26, wherein said slack portion exhibits a first curvature when said seat back and said seat bottom are in the original position and is deformed to exhibit a different second curvature upon application of the force at said upper portion of said seat back.

* * * * *

UNITED STATES PATENT AND TRADEMARK OFFICE

CERTIFICATE OF CORRECTION

PATENT NO. : 6,722,735 B2
DATED : April 20, 2004
INVENTOR(S) : Lucci et al.

It is certified that error appears in the above-identified patent and that said Letters Patent is hereby corrected as shown below:

Column 10,
Line 1, replace “16” with -- 17 --
Lines 4 and 7, replace “17” with -- 18 --

Signed and Sealed this

Twenty-eighth Day of September, 2004

JON W. DUDAS
*Director of the United States Patent and Trademark Office*